US006736534B1

(12) United States Patent
Fite

(10) Patent No.: US 6,736,534 B1
(45) Date of Patent: May 18, 2004

(54) ENTRY DOOR WITH ILLUMINATED GLASS INSERT

(76) Inventor: Robin L. Fite, 430 Apache Trail, Merritt Island, FL (US) 32953

( * ) Notice: Subject to any disclaimer, the term of this patent is extended or adjusted under 35 U.S.C. 154(b) by 0 days.

(21) Appl. No.: 10/252,908

(22) Filed: Sep. 23, 2002

(51) Int. Cl.[7] ..... F21W 131/107

(52) U.S. Cl. ..... 362/576; 362/31; 362/145; 362/565; 362/253; 52/204.59

(58) Field of Search ..... 362/31, 576, 565, 362/145, 253; 52/204.59

(56) References Cited

U.S. PATENT DOCUMENTS

| | | | | |
|---|---|---|---|---|
| 3,303,616 A | | 2/1967 | Brown | 52/213 |
| 3,789,210 A | | 1/1974 | Weber et al. | 240/7.3 |
| 3,867,621 A | | 2/1975 | Gewfrtz et al. | 240/2 R |
| 4,309,744 A | | 1/1982 | Catanese | 362/147 |
| 4,825,615 A | | 5/1989 | Turner | 52/455 |
| D313,477 S | | 1/1991 | Hall | D25/103 |
| 5,018,330 A | | 5/1991 | Lewkowitz | 52/455 |
| 5,297,010 A | | 3/1994 | Camarota et al. | 362/80 |
| 5,450,292 A | | 9/1995 | Yokoyama et al. | 362/31 |
| 5,712,615 A | | 1/1998 | Maffey et al. | 340/332 |
| 5,901,768 A | | 5/1999 | Herbst | 160/90 |
| 6,059,420 A | * | 5/2000 | Rogers | 362/92 |
| 6,185,883 B1 | * | 2/2001 | Howard | 362/204.59 |
| 6,273,579 B1 | | 8/2001 | Holloway | 362/100 |

* cited by examiner

*Primary Examiner*—Laura K. Tso
(74) *Attorney, Agent, or Firm*—Brian S. Steinberger; Law Offices of Brian S. Steinberger, P.A.

(57) ABSTRACT

Entry doors having transparent insert panels such as etched glass and/or stained glass with tube lights such as 12 mm neon tube lights imbedded in framing along the outer edges of the panels inside the doors. Photo cells can be used to turn on the lights in the dark. Relays can turn on power when the door is closed and spring loaded switches can provide contact between the neon tubes and a transformer before power is supplied.

20 Claims, 7 Drawing Sheets

Fig.8A
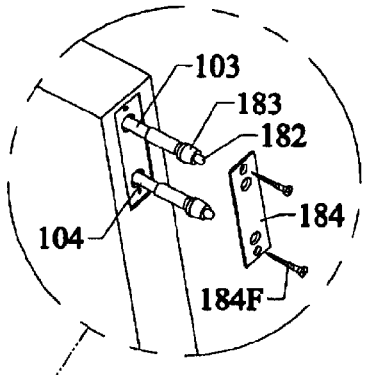
Fig.7
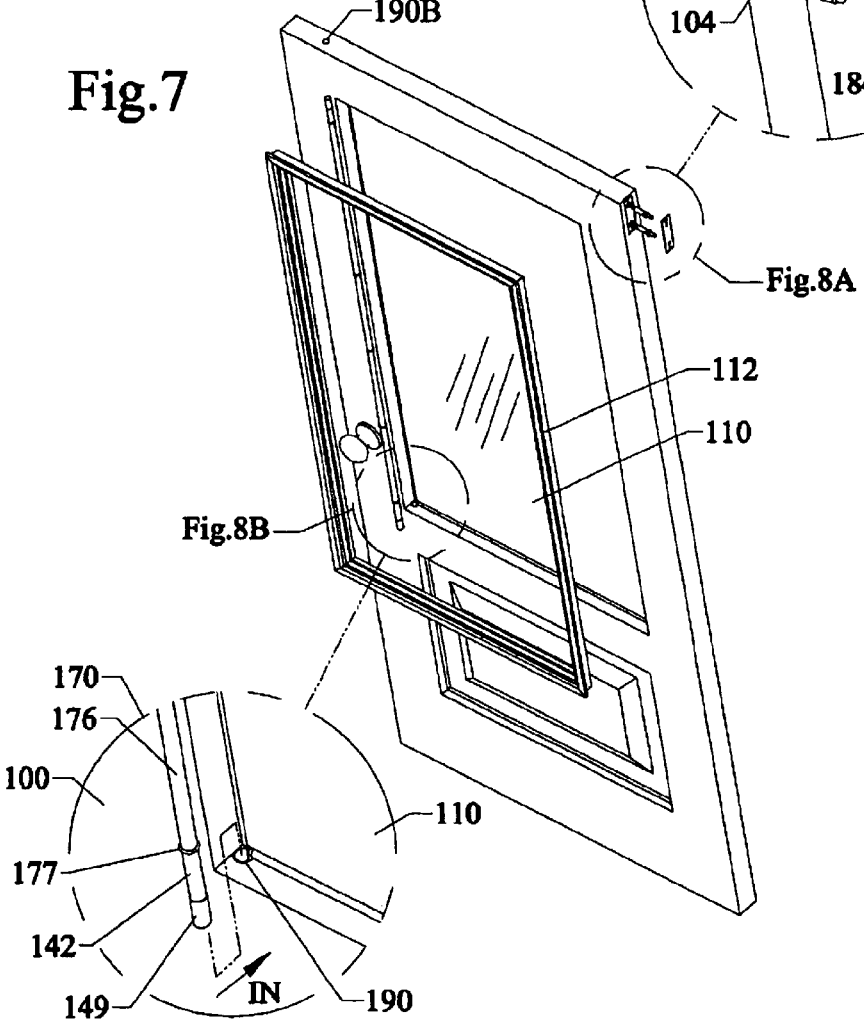
Fig.8B

ENTRY DOOR WITH ILLUMINATED GLASS INSERT

This invention relates to doors, in particular to a method and apparatus for illuminating transparent panels such as but not limited to etched glass, stained glass, glazed glass and the like, preferably on entry type doors using longitudinal light sources such as neon tube lights mounted directly inside channels within the doors adjacent to outer edges of the transparent insert panels.

BACKGROUND AND PRIOR ART

It has become popular of the years to use see-through partially opaque panels such as using elaborate stained glass panels with entry doors on homes. See for example, U.S. Pat. No. Des. 313,477 to Hall; U.S. Pat. No. 4,825,615 to Turner; U.S. Pat. No. 5,018,330 to Lewkowitz; and U.S. Pat. No. 5,901,768 to Herbst. While being aesthetically visible during daytime hours, any elaborate glass panels such as stained glass are not easily visible at night. Thus, these panels offer little if no aesthetic appeal at night.

Home owners have often required exterior lights in order to illuminate the outside of their entry doors that have usually encompassed the use of plane exterior mounted lamps that must be mounted to the walls adjacent to the doors. While popular, the wall mounted lamps do not uniformally illuminate the doors, nor provide an attractive light for the doors themselves. Also, most wall mounted lamps are limited to white light and have few color alternatives. Still furthermore, wall mounted lamps do little if no assistance to helping illuminate any elaborate glass type panels such as stained glass panels on entry doors.

Other types of well known exterior lights have included string lights. However, string lights are usually limited to being used during holidays, and also generally require the use of light bulbs, which can generate excessive heat which is dangerous, are easily breakable and cost substantial amounts in power costs when used over long periods of time. In addition, string lights do not illuminate the glass type insert panels of entry doors since they are attached outside of the doors.

Over the past years, several proposals have been made to illuminate portions of doors. See for example, U.S. Pat. No. 3,303,616 to Brown; U.S. Pat. No. 3,789,210 to Weber et al.; U.S. Pat. No. 3,867,621 to Gewfrtz et al.; and U.S. Pat. No. 4,309,744 to Catanese. However, these devices are limited to providing light about the outer frames of doors, and these devices do not allow for illuminating any glass inserts in the doors themselves. None of these devices provides the light source inside the door itself, and instead puts the light in surrounding framing about the doors. Still furthermore, these devices generally use light bulbs, which have excessive power costs, and generate heat and are not desirable for used over long periods of time.

U.S. Pat. No. 5,450,292 to Yokoyama et al. describes a surface light source for illuminating panels. However, this device is not directed to nor is described for safely and effectively illuminating glass insert panels on entry doors. There are no descriptions, teachings, nor controls for activating these lights within entry doors. In addition this reference relies on fluorescent tubes for their illumination which may use less power than traditional light bulbs but have other similar problems such as requiring ballasts to power the tubes. In addition fluorescent tubes are generally limited to white coloring. Thus, this device limits the aesthetic effects by not allowing the glass panel inserts on the entry doors to be illuminated by different colored lights.

Lights on doors have been proposed but still fail to directly illuminate any glass insert panels on the doors. See U.S. Pat. No. 5,297,010 to Camarota et al.; U.S. Pat. No. 5,712,615 to Maffrey et al.; and U.S. Pat. No. 6,273,579 to Holloway. These devices are limited to lighting exterior attachments to the doors such as the door knobs, which does nothing to directly illuminate the glass type insert panels on the entry doors.

Thus, there exists the need for a practical solution for illuminating glass type panel inserts on entry doors without the above drawbacks.

SUMMARY OF THE INVENTION

The first objective of the present invention is to provide a method and system for illuminating transparent panel inserts such as etched and/or stained glass panels, on entry doors in a uniform manner, without using any wall mounted or exterior mounted lights.

The second objective of the present invention is to provide a method and system for illuminating transparent panel inserts on entry doors using light sources that last longer, use less power, and generate less heat than light bulbs.

The third objective of the present invention is to provide a method and system for illuminating transparent panel inserts on entry doors with light sources inside the doors.

The fourth objective of this invention is to provide a method and system for illuminating transparent panel inserts on entry doors with light sources that can be easily interchanged with different colors as needed and desired.

The fifth objective of the present invention is to provide a method and system for illuminating transparent panel inserts on entry doors with light sources that can be easily activated on and off, as well as be dimmed overtime.

The sixth objective of the present invention is to provide a method and system for illuminating transparent panel inserts on entry doors for use as a nightlight when used after dark.

A preferred embodiment of the novel door system for illuminating transparent panels on doors, can include a door having a light transparent panel on the door, the door mounted to a frame, light sources for illuminating at least one side edge of the panel, the light sources being located inside of the doors and controls for switching the illuminating the light sources on and off. The door can include an exterior entry door on a residence or commercial building. The light sources can include one or more light tubes such as neon lights that can be mounted within spring biased housings along side edge(s) of the transparent panel within channel(s) inside of the doors. The light sources can be mounted within shock absorbing members such as but not limited to O-rings and the like. The light sources can be activated by photocells, timers, and the like, and be selectively turned on and off only when the door is closed.

Further objects and advantages of this invention will be apparent from the following detailed description of a presently preferred embodiment which is illustrated schematically in the accompanying drawings.

BRIEF DESCRIPTION OF THE FIGURES

FIG. 7 is an exploded perspective view of the transparent panel separated from the door of FIG. 2.

FIG. 8A is an enlarged view of a spring pin retaining plate for holding in the spring loaded contact switches in FIG. 7.

FIG. 8B is an enlarged view of the conductor and light source contacts within the door.

DESCRIPTION OF THE PREFERRED EMBODIMENT

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

Figure 1:
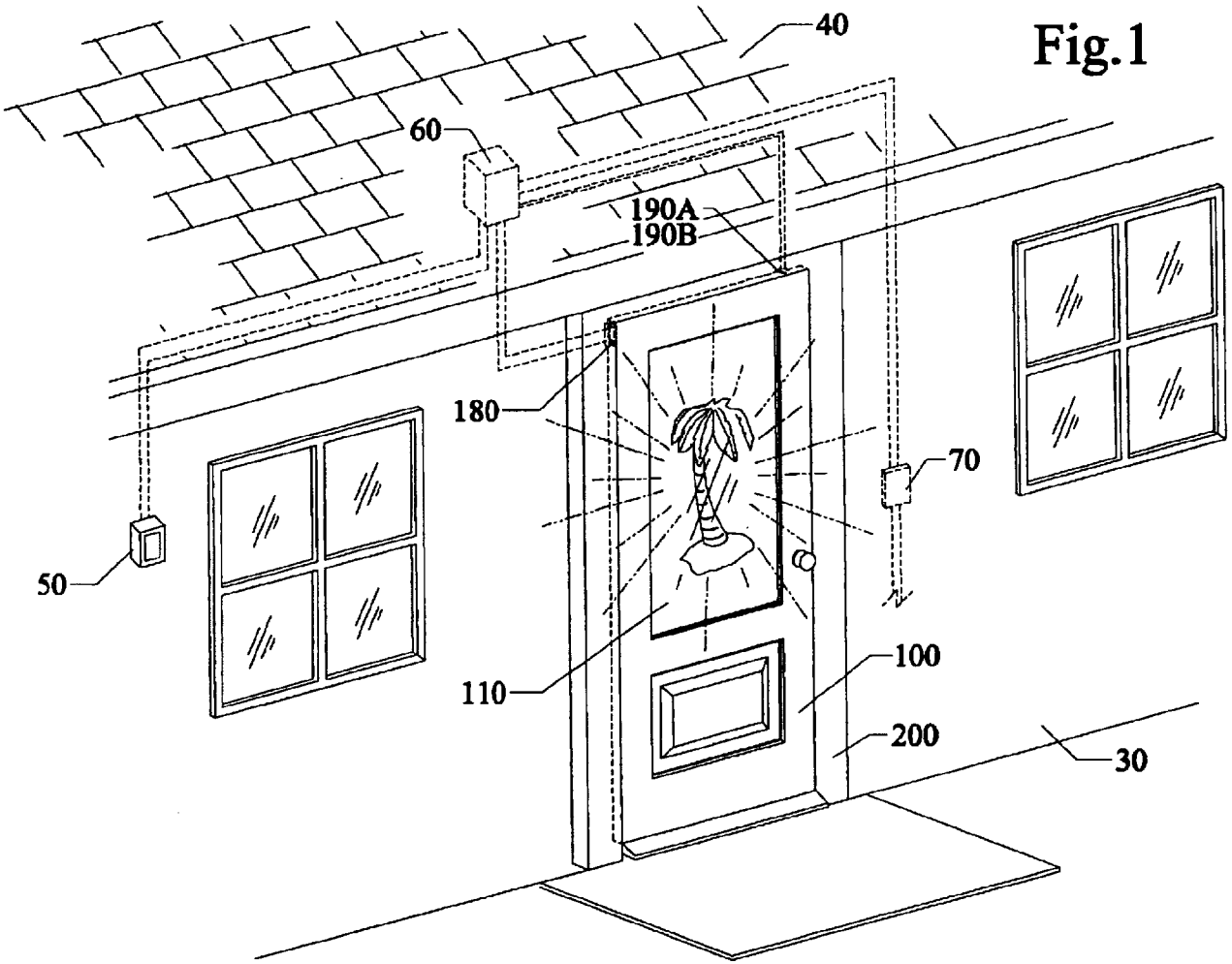
FIG. 1 is a perspective partial cross-sectional view of the novel illuminated entry door mounted to a door frame on a house.

FIG. 1 is a perspective partial cross-sectional view of the novel illuminated entry door 100 mounted to do a door frame 200 on a house 30. An optical switch 50 can be mounted on the front of the house 30 and can house photo cell(s) for activating the lights, and be connected to the door 100 via a control box 60 that can be mounted above the door 100 within the house 30. The control box connects to the door 100 via a spring contact switch 180 and a magnetic switch 190, which will be explained later in greater detail.

Figure 2:
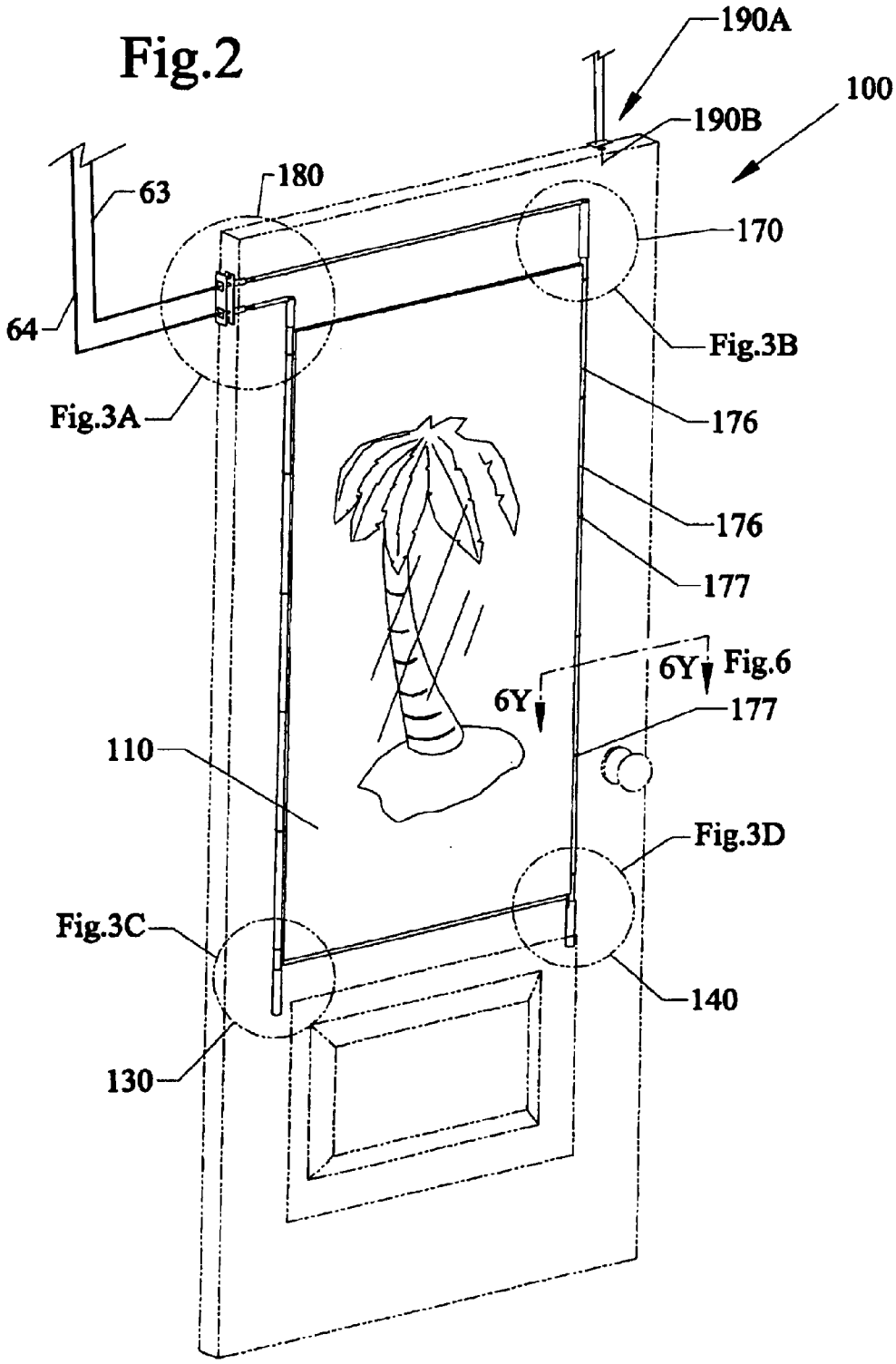
FIG. 2 is a perspective enlarged view of the illuminated entry door of FIG. 1.

FIG. 2 is a perspective enlarged view of the illuminated entry door 100 of FIG. 1.

Figure 3A:
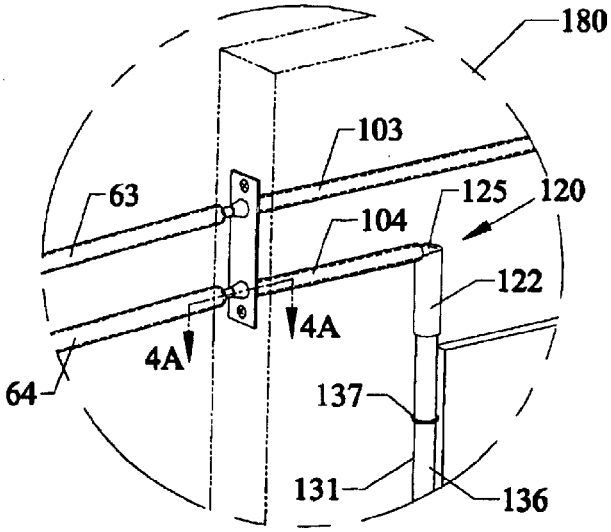
FIG. 3A is an enlarged view of the upper left corner contact switch for the door of FIG. 2.

FIG. 3A is an enlarged view of the upper left corner contact switch 180 for the door of FIG. 2. FIG. 4A is an enlarged cross-sectional view of the contact switch 180 between the door 100 and jamb portion 210 of FIG. 3A along arrows 4A in an open position.

FIG. 7 is an exploded perspective view of the transparent panel 110 separated from the door 100 of FIG. 2 with panel trim 112, which will be described in more detail later. FIG. 8A is an enlarged view of a spring pin retaining plate 184 with plate fasteners 184F, such as but not limited to screws, and the like, for holding conductive spring biased pins 182 within sleeve 183 of FIG. 7.

Referring to FIGS. 2, 3A, 3B, 7 and 8A, insulated conductors 63, 64 pass from control box 60 to door 100 via insulated conductors 63, 64. Only one of the conductors 64 will now be described. Insulated conductor 64 can be imbedded in doorjamb portion 210 and exit the side edge 212 of door jamb portion 210 by having the insulated conduit portion 64I extending to edge 212, and the conductive portion 64 there between. Inside the upper left corner of door 100 can be a moveable conductive pin that can be held within a cavity chamber by a spring biasing plate 184 by having an enlarged stem end portion 183, which is biased to extend outward in the direction of arrow E by a conductive spring 185 which in turn is held in place by a cylindrical insulated sleeve 1041 which also houses a conductive wire portion 104C which passes to a lights to be later described in detail. Upper wire portion 103 also connects an identical spring contact switch 180 to that shown by FIG. 4A.

Figure 4B:
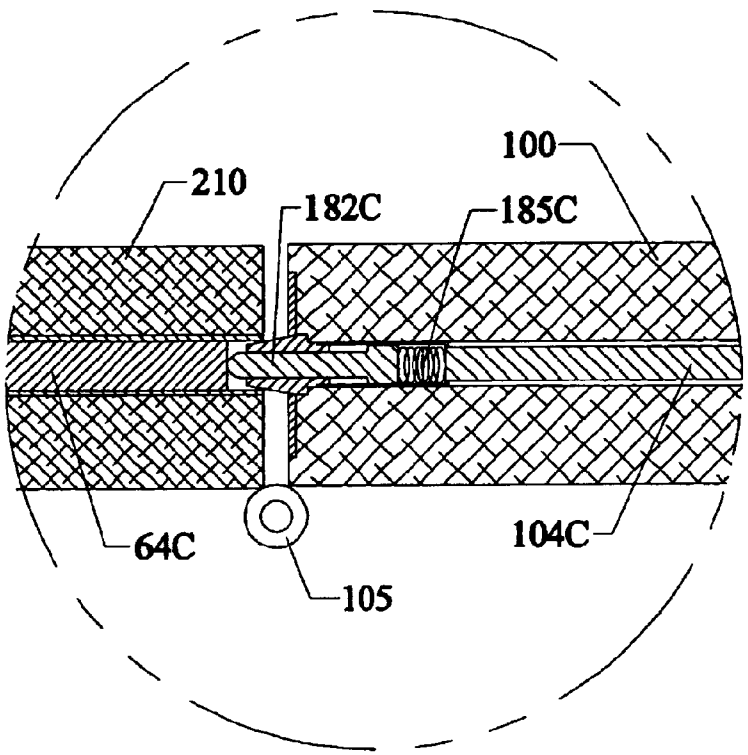
FIG. 4B is another cross-sectional view of the contact switch between the door and jamb of FIG. 4A in a closed position.
Figure 4A:
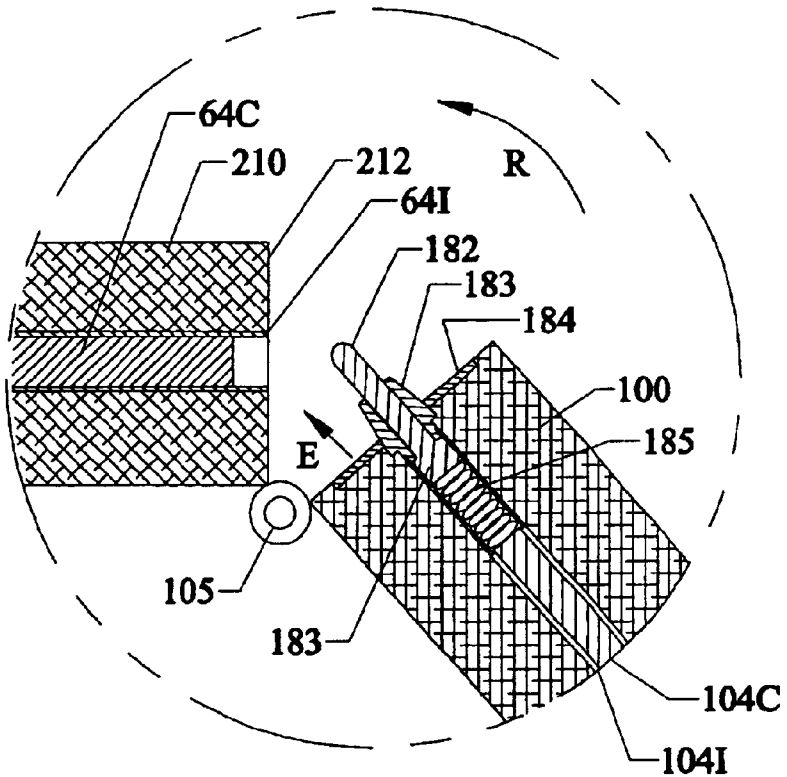
FIG. 4A is an enlarged cross-sectional view of the contact switch between the door and jamb of FIG. 3A along arrows 4A in an open position.

FIG. 4B is another cross-sectional view of the contact switch 180 between the door 100 being rotated in the direction of arrow R about a hinge portion 105 to jamb portion 210 of FIG. 4A to a closed position. Referring to FIGS. 2, 3A and 4B, in the closed door position the compressed conductive pin 182 contacts conductive inside wire portion 64C so that a continuous conductive path exists between conductive wire portion 64C, compressed pin 182C, compressed spring 185C and conductive wire portion 104C inside the door 100. When the door is opened in the opposite direction of arrow R(FIG. 4A), spring 185 expands outward causing pin 182 to extend in the direction of arrow E so that a fully opened door breaks the conductive path between wire portion 64C in the door jamb 210 and conductive wire portion 104C in the door 100. This operation would also be identical for the upper insulated wires 63 and 103.

Figure 3B:
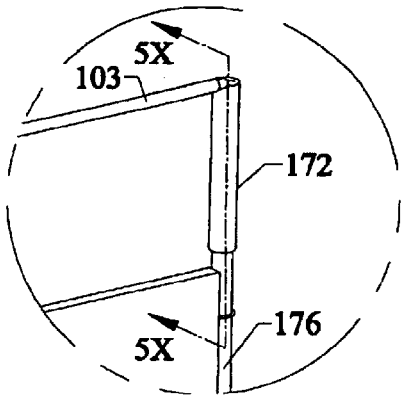
FIG. 3B is an enlarged view of the upper right corner light socket for the door of FIG. 2.
Figure 5:
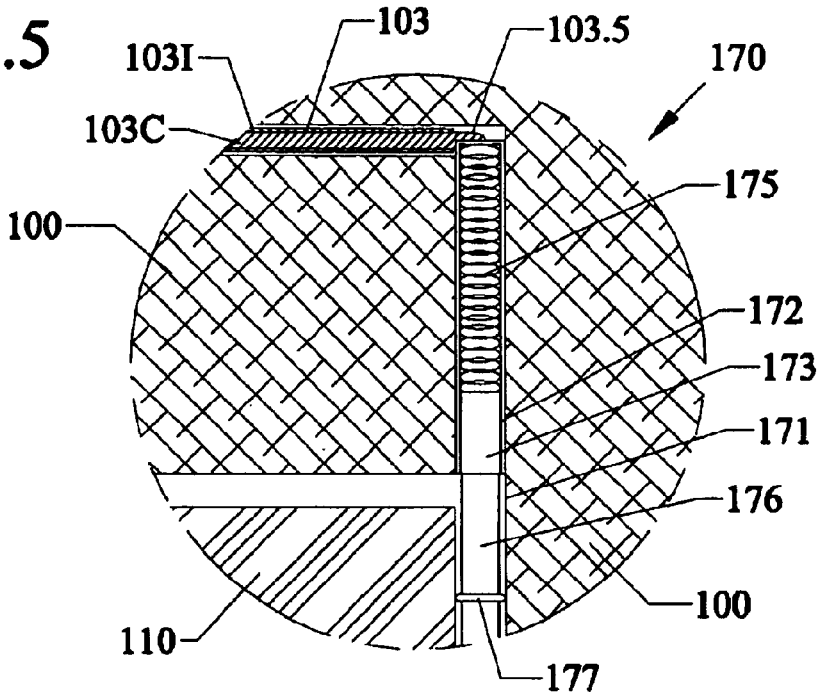
FIG. 5 is a cross-sectional view of the upper right corner light socket of FIG. 3B along arrows 5X.
Figure 6:
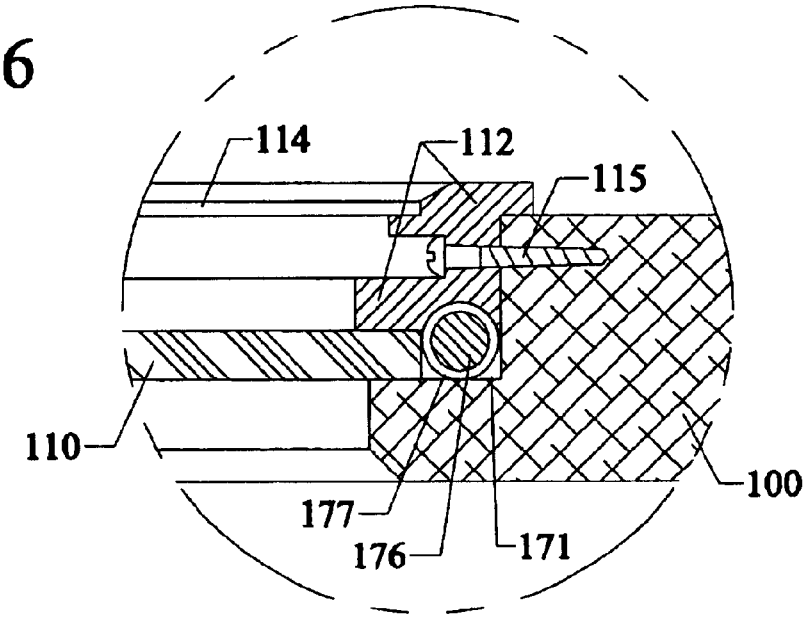
FIG. 6 is a cross-sectional view of right interior longitudinal light source of FIG. 2 along arrows 6Y.

FIG. 3B is an enlarged view of the upper right corner light socket portions 170 for the door 100 of FIG. 2. FIG. 5 is a cross-sectional view of the upper right corner light socket portion 170 of FIG. 3B along arrows 5X. FIG. 6 is a cross-sectional view of right interior longitudinal light source 176 of FIG. 2 along arrows 6Y.

Referring to FIGS. 2, 3B, 5 and 6, insulated wire 103 can pass along and inside an upper portion of the door 100 in a horizontal direction having a conductive wire portion 103C within an insulated outer layer 1031, and have an extended conductive end portion 103.5 which can be soldered to an upper edge of a compressible light tube contact spring 175. An upper right cylindrical light socket 172 can run vertically inside the right hand side of the door 100 can be imbedded within a channel 171 that runs adjacent to the transparent insert 110. The spring 175 can also abut against a conductive light tube contact 173 which in turn can abut against an upper end of a light tube 176. About the light tube 176 can be flexible nonconductive ring 177, such as an O-ring which can function as a shock absorber within channel 171 and an interior edge of transparent door insert panel 110.

Referring to FIGS. 2 and 6, both transparent panel insert such as etched glass, stained glass and glazed glass, and an optional transparent glass type cover panel 114 can be held in place to the door by retaining trim 112 which can be held in place by fasteners such as but not limited to screws and the like, to an inside edge of the door 100. Plural light tubes 176 such as but not limited to approximately 12 mm neon tubes, that can range between approximately 6 inches to approximately 6 feet in length with or without shock absorbing rings 177 about the light tubes 176, can run vertically along the right side edge of transparent panel 110.

Figure 3C:
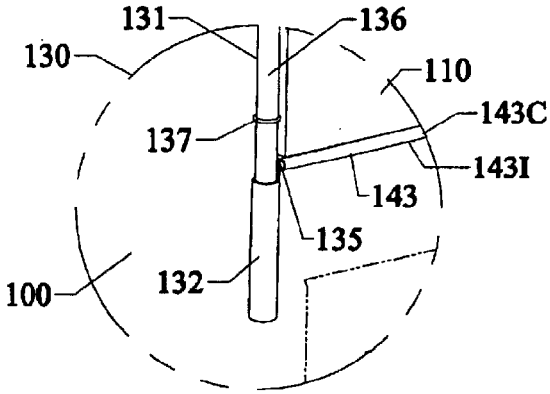
FIG. 3C is an enlarged view of the lower left corner light socket for the door of FIG. 2.

FIG. 3C is an enlarged view of the lower left corner light socket connectors 130 for the door 100 of FIG. 2. A vertical column of light tube(s) 136 can be mounted within a channel along the left edge of door 100 adjacent to left side edge of the transparent panel insert 110 similar to that of the right light tube(s) 176 previously described. The lower end of left vertical light tube(s) 136 can also fit inside a lower left cylindrical light tube socket 132, which is similar to the upper right cylindrical light tube socket 172, which was previously described. The lower left door light tube socket 132 connects to the lower right door light tube socket 142 by a soldered connection to wire 143, which is similar to the previous wires described by having an insulated outer layer 143I about a conductive core portion 143C.

Referring to FIGS. 3A, 3C and 2, the upper portion of the left mounted vertically oriented light tube(s) 136 are mounted by upper light connector 120 having an upper left cylindrical light tube socket 122 which is similar to the other light tube socket connectors that were previously described. Also, shock absorber type O-rings can also be used about the left vertical light tube(s) 136 to safely mount the light tube(s) 136 within the door channel 131 in door 100 adjacent to the left side edge of transparent panel insert 110.

Figure 3D:
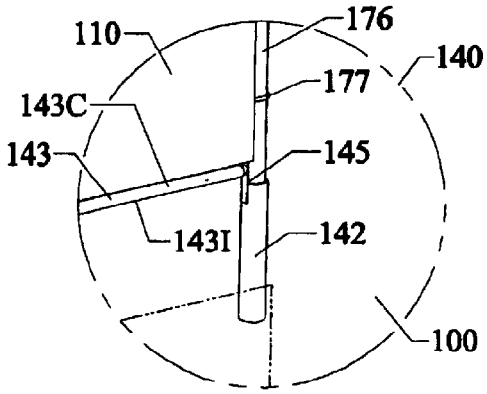
FIG. 3D is an enlarged view of the lower right corner light socket for the door of FIG. 2.

FIG. 3D is an enlarged view of the lower right corner light socket connectors 140 for the door 100 of FIG. 2.

FIG. 7 is an exploded perspective view of the transparent panel 110 separated from the door 100 of FIG. 2. FIG. 8B is an enlarged view of the lower right light source conductors 170 within the door 100.

Referring to FIGS. 2, 3D, 6, 7 and 8B, the lower end of right vertical light tube(s) 176 can fit inside a lower right cylindrical light tube socket 142 which is similar to the upper right cylindrical light tube socket 172, previously described. A conductive wire 143 can run horizontally along and inside of the lower part of door 100 below transparent panel insert 110. Wire 143 can also have an insulated outer layer 1431 about a conductive core portion 143C which can attach to the tube socket 142 by a conductive solder joint 145.

Referring to FIG. 8B, a lower capped end portion 149 on socket 142 can be inserted into a cavity 190 within door 100 adjacent to the lower right corner 110 of the transparent panel insert 110. This cavity 190 and similar capped end portion 149 can also be used for the other light conductor portions 120, 130, 170, respectively, for allowing for a better mount of the light conductors.

The control box 60 connects to the door 100 via spring contact switches 180 and a magnetic switch 190A. A functional description of the magnetic switch will now be described.

An approximately ¼" diameter hole 190B can be drilled into the top of door 100, and approximately 1" deep within the hole is a magnet. When the door 100 is in the open position FIG. 4A the magnetic switch 190A can be in an open circuit which turns the power to the control box 60 off so the spring contact switches 180 have no power flowing through them which is a safety feature.

When the door 100 is in the closed position, FIG. 4B, the magnet 190B which is in the top of the door 100 can align with and close magnetic switch 190A which closes the circuit which returns power to control box 60, thus returning power to door 100.

In short when the door 100 is partly opened but before spring loaded contact switches 180 break contact, the magnetic switch 190A disconnects power to the door 100 which eliminates any chance of sparks which could result.

When door 100 is being closed, spring loaded contact switches 180 make positive contact before magnetic switch 190A allows power through them.

Figure 9:
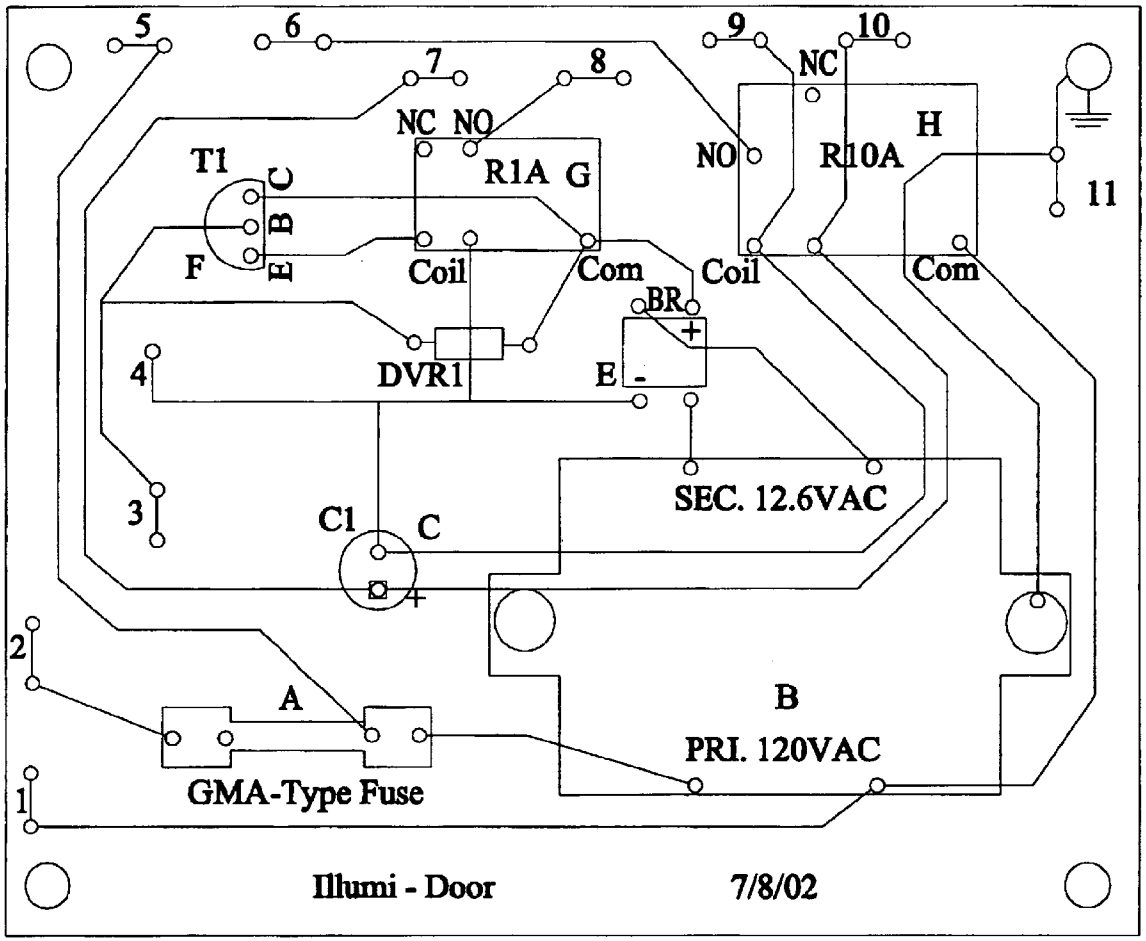
FIG. 9 is a schematic diagram of a preferred control box and dimmer switch control for the above figures.

FIG. 9 is a schematic diagram of a preferred control box and dimmer switch control for the above figures. Referring to FIG. 9, a photo cell 3, 4, can turn the power on at night and off during the day. Photo cell 3, 4 works through an NPN transistor F, a 100 k-Ohm Resistor D, and SPDT 12 VDC 1 A relay G, the latter of which needs to be activated before the unit powers up. Under a darkness condition, power enters the control box via wall switch/dimmer 1, 2, which powers a low volt AC transformer B, which is changed to DC through a bridge rectifier E. When the door is closing, spring pins contact the insulated conductors in doorjamb (See FIGS. 4A, 4B, 7 and 8A) making a positive contact before being closed. When the door is closed a concealed magnetic switch in the doorjamb and the top of the door (FIGS. 1, 7) activates a relay G, which closes another relay H that powers a transformer 5, 6 FIG. 1, which in turn powers neon tubes concealed within the door cavity around the glass insert. While the control box is in operation a 12 volt fan 9, 10 can come on to keep the components cool. All components in FIG. 9 can be enclosed in a Type 1 grounded 11, enclosure UL listed 3F77 with holes drilled to provide ventilation and access for wires. The control box can have dimensions of approximately 6" by approximately 6" by approximately 4" with a removable top for accessibility.

The operation of the magnetic switch 190A will now be described in reference to FIGS. 1 and 9. Relay G can be a low volt relay which photo cell 50 terminals 3–4 and magnetic switch 190A terminals 7–8 are connected to control relay H which controls power to a high volt transformer terminals 5–6 which powers door 100.

In FIG. 9, terminals 7–8 can be an open circuit which does not allow power to relay H. Terminals 7–8 can be connected to magnetic switch 190A(FIG. 1) which closes the circuit when the door 100 is closed.

The operation of the dimmer switch will now be described. Once power is turned on to door via a wall switch 1, 2, illumination can be adjusted by a dimmer that is mounted beside a switch. For example, terminal 5 can be removed and connected to red wire or 12/3 or 14/3 house wiring that exists. The dimmer switch can be of any wattage or style, such as but not limited to a touch, slide, step, rotary, and the like. The dimmer switch can be rated for incandescent lights. The switch and dimmer can have two separate switches due to the low voltage to low volt transformer B, which can affect performance.

While the preferred embodiment refers to using photo cells to turn on and off the light sources, the light sources can also be controlled by timers, and the like, and combinations of components such as timers and photocells.

Although the preferred embodiment has been described for use with entry doors, the invention can be used with other types of doors having transparent type insert panels such as but not limited to cabinet doors, and displays doors, and the like.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A door system for illuminating transparent panels on doors, comprising in combination:

a door having a light transparent panel on the door, the door mounted to a frame;

means for illuminating at least one side edge of the panel, the illuminating means being located inside of the door; and means for switching the illuminating means on and off, the illuminating means including a switch which becomes activated when the door is closed.

2. The system of claim 1, wherein the door includes: an exterior swinging entry door.

3. The system of claim 1, wherein the illuminating means includes:

a first longitudinal light source mounted along one side edge of the transparent panel.

4. The system of claim 3, further comprising:

a channel for housing the first longitudinal light source.

5. The system of claim 3, wherein the illuminating means includes:

a second longitudinal light source mounted along a second longitudinal side edge of the transparent panel, the first mounted longitudinal light source being parallel to and being on opposite edges of the transparent panel to the second mounted longitudinal light source.

6. The system of claim 1, wherein the illuminating means includes: a neon tube.

7. The system of claim 1, wherein the switch includes:

a spring loaded portion.

8. The system of claim 7 wherein the spring loaded portion includes:

a conductive spring biased pin which contacts a conductor when the door is closed.

9. The system of claim 8, wherein the spring loaded portion includes:

means for mounting the spring loaded portion adjacent to a hinge on the door.

10. The system of claim 1, wherein the switch includes:

a magnetic switch portion.

11. The system of claim 10, wherein the magnetic switch portion includes:

a first portion on a door jamb and a second portion on an edge of the door, wherein the magnetic switch portion is closed when the door is closed.

12. The system of claim 3, further comprising:

a flexible non conductive member for mounting the longitudinal light source so that shock and vibration is absorbed before reaching the longitudinal light source.

13. The system of claim 10, wherein the member includes:

at least one O-ring wrapped about the longitudinal light source.

14. A door system for illuminating transparent panels on doors, comprising in combination:

a door having a light transparent panel on the door, the door mounted to a frame;

a longitudinal light source for illuminating at least one side edge of the panel, the longitudinal light source being located inside of the door; and a flexible non conductive member for mounting the longitudinal light source inside the door so that shock and vibration is absorbed before reaching the longitudinal light source.

15. The door system of claim 14, wherein the member includes:

at least on O-ring wrapped about the longitudinal light source.

16. An illuminated door system comprising:

a door having a light transparent panel, the door mounted to a frame;

a light source on the door for illuminating at least one side edge portion of the panel; and a switch for switching the light source on and off, the switch becoming activated when the door is closed.

17. The door system of claim 16, wherein the switch includes:

a spring loaded portion.

18. The door system of claim 17, wherein the spring loaded portion includes:

a conductive spring biased pin which contacts a conductor when the door is closed.

19. The system of claim 18, wherein the spring loaded portion includes:

means for mounting the spring loaded portion adjacent to a hinge on the door.

20. The system of claim 16, wherein the switch includes:

a magnetic switch portion.

* * * * *